United States Patent [19]

Asano

[11] 4,123,999

[45] Nov. 7, 1978

[54] FEEDBACK AIR-FUEL RATIO CONTROL SYSTEM FOR INTERNAL COMBUSTION ENGINE CAPABLE OF PROVIDING CONSTANT CONTROL SIGNAL AT START OF FUEL FEED

[75] Inventor: Masaharu Asano, Yokosuka, Japan

[73] Assignee: Nissan Motor Company, Ltd., Japan

[21] Appl. No.: 734,115

[22] Filed: Oct. 20, 1976

[30] Foreign Application Priority Data

Oct. 28, 1975 [JP] Japan ..... 50/128908

[51] Int. Cl.[2] ..... F02B 3/08; F02M 7/12; F01N 3/08

[52] U.S. Cl. ..... 123/32 EE; 123/119 EC; 123/32 EG; 60/276; 60/285

[58] Field of Search ..... 123/32 EE, 32 EG, 32 EA, 123/119 EC; 60/276, 285

[56] References Cited

U.S. PATENT DOCUMENTS

| | | | |
|---|---|---|---|
| 2,389,797 | 11/1945 | McNeil | 60/276 |
| 3,875,907 | 4/1975 | Wessel et al. | 60/276 |
| 3,900,012 | 8/1975 | Wahl et al. | 123/32 EE |
| 3,916,170 | 10/1975 | Norimatsu et al. | 123/32 EE |
| 3,919,983 | 11/1975 | Wahl et al. | 123/32 EE |
| 3,960,118 | 6/1976 | Konomi et al. | 60/276 |
| 3,973,529 | 8/1976 | Wessel et al. | 123/32 EA |
| 4,006,718 | 2/1977 | Konomi | 123/32 EE |
| 4,019,470 | 4/1977 | Asano | 60/276 |
| 4,029,061 | 6/1977 | Asano | 60/276 |

*Primary Examiner*—Charles J. Myhre
*Assistant Examiner*—P. S. Lall

[57] ABSTRACT

In a feedback control system for maintaining the air fuel ratio of a combustible mixture fed to an internal combustion engine at a preset ratio based on a feedback signal representing the concentration of a certain component of the exhaust gas, a control signal producing circuit is provided with a sub-system for holding the control signal constantly at a preset level for a predetermined amount of time immediately after the start of the fuel feed to the engine in order to prevent an unintentional lowering of the air-fuel ratio due to a delay in the development of the feedback signal from the start of the fuel feed.

12 Claims, 12 Drawing Figures

FEEDBACK AIR-FUEL RATIO CONTROL SYSTEM FOR INTERNAL COMBUSTION ENGINE CAPABLE OF PROVIDING CONSTANT CONTROL SIGNAL AT START OF FUEL FEED

This invention relates to a feedback control system for maintaining the air-fuel ratio of a combustible mixture which is fed to an internal combustion engine at a preset ratio based on a feedback control signal produced by a gas concentration sensor installed in the exhaust line of the engine.

For minimizing the concentrations of pollutants in the exhaust gas of an internal combustion engine, it is important to maintain the air-fuel ratio of a combustible mixture which is fed to the engine at a preset ratio. As is well known, the air-fuel ratio realized in the engine can be estimated from the concentration of a certain component of the exhaust gas, (which may be $O_2$, CO, $CO_2$, HC or $NO_x$) and various types of exhaust sensors for this purpose are now available. In known feedback control systems for precisely controlling the air-fuel ratio, a control signal for regulating the fuel feed rate and/or the air feed rate in an air-fuel proportioning device such as a carburetor or a fuel injection system is typically produced in the following manner. (Of course, the air-fuel proportioning device is controlled also by other factors typified by the manipulation of a throttle valve.) Any deviation of the output of an exhaust sensor from a preset reference voltage (which corresponds to the preset air-fuel ratio) is detected in a deivation detection circuit such as a differential amplifier or a comparator, and a control circuit produces the control signal by either multiplying or integrating the detected deviation, or alternatively by the addition of the integrated deviation to the multiplied deviation, so that the control signal has a proportional component and an integral component.

The value of the preset air-fuel ratio is so determined as to bring about an optimum function of an emission control system provided to the engine. For example, the preset ratio is usually in the vicinity of a stoichiometric ratio when the emission control system employs as its important element a catalyst which catalyzes both the reduction of nitrogen oxides and the oxidation of hydrocarbons and carbon monoxide upon contact with the exhaust gas of the engine.

Aside from the control of the air-fuel ratio, some of current automotive engines are provided with a fuel cut-off mechanism for the purpose of temporarily stopping the feed of fuel to the engine under certain deceleration conditions typified by an engine brake condition (detected from such factors as the degree of the throttle valve opening and the engine speed) thereby to attain improved drivability and fuel consumption.

When the engine is provided with the above described air-fuel ratio control system, the provision of the fuel cut-off mechanism offers a problem that the air-fuel ratio significantly deviates from the preset ratio during and subsequently to the operation of the fuel cut-off mechanism. In the air-fuel ratio control system, the control signal supplied to the air-fuel proportioning device is varied to raise and lower the air-fuel ratio when a realized air-fuel ratio (detected by the exhaust sensor) is below and above the preset ratio, respectively. Since the realized air-fuel ratio greatly rises by the cut-off of the fuel feed, the control signal so varies as to cause a great loweing of the air-fuel ratio while the fuel cut-off mechanism is in action. When the fuel feed is resumed, therefore, the air-fuel proportioning device supplies a combustible mixture having an air-fuel ratio significantly lower than the preset ratio. Of course the air-fuel ratio control system so works thereafter as to raise the air-fuel ratio until the preset ratio is realized. However, it takes a certain amount of time (usually several seconds from the moment of the fuel feed resumption) to realize the preset air-fuel ratio. Consequently, an excessively fuel-rich mixture is supplied to the engine for this amount of time, and hence the emission control system cannot work at an expected efficiency. If the emission control system includes a catalyst, an excessively low air-fuel ratio of the combustible mixture might sometimes cause damage of the catalyst upon contact with the resulting exhaust gas. A similar problem is encountered at starting of the engine.

It will seem possible to solve the above described problem by holding the control signal in a definite state (for example, corresponding to the preset air-fuel ratio) while the feed of the fuel to the engine is stopped and allowing the control signal to resume a variation simultaneously with the resumption of the fuel feed. However, the air-fuel ratio control system so works as to lower the air-fuel ratio for a certain amount of time from the moment of the fuel feed resumption even though this method is employed since there is a time lag between the resumption of the fuel feed and the detection of the realized air-fuel ratio by the exhaust sensor.

With respect to a feedback control system of the above described type for maintaining the air-fuel ratio of a combustible mixture fed to an internal combustion engine at a preset ratio, it is an object of the present invention to provide a method of preventing a significant deviation of the controlled air-fuel ratio from the preset ratio for a certain period of time immediately after either the commencement or resumption of the feed of fuel to the engine.

It is another object of the invention to provide an improved feedback control system of the above described type for an internal combustion engine, particularly an automotive engine, which system includes as a point of improvement a sub-system for causing the control system to supply a constant control signal to an air-fuel proportioning device for a predetermined period of time immediately after either the commencement or resumption of the feed of fuel to the engine.

According to the invention, the control signal of the air-fuel ratio control system is temporarily held constantly in a predetermined state for a predetermined amount of time immediately after the start of the feed of fuel, i.e., a combustible mixture, from the air-fuel proportioning device to the engine either at a starting of the engine or at the end of a temporary interruption of the fuel feed during operation of the engine. The predetermined amount of time corresponds to a time delay in the arrival of the exhaust gas at the exhaust sensor after the start of the fuel feed.

An air-fuel ratio control system according to the invention comprises, in addition to the above described components, a monitoring circuit which is responsive to the fuel feed function of the air-fuel proportioning device and produces a monitoring signal indicating whether the fuel feed is performed or not, and a hold signal producing circuit which supplies a hold signal to the control circuit for a predetermined amount of time from the moment the monitoring signal indicates the start of the fuel feed. The control circuit is provided with a switching circuit for holding the control signal constantly in a predetermined state while the hold signal is supplied to the control circuit.

The hold signal producing circuit may be constructed to have the ability of supplying the hold signal to the control circuit also while the monitoring signal indicates that the fuel feed is not accomplished.

An example of the monitoring circuit has a transistor to utilize its collector voltage as the monitoring signal and a capacitor the voltage of which governs the conductivity of the transistor.

An example of the hold signal producing circuit has a transistor to utilize its collector voltage as the hold signal and an r-c circuit, an integrating circuit or a differentiating circuit for governing the conductivity of the transistor based on the output of the monitoring circuit.

This invention will fully be understood from the following detailed description of preferred embodiments with reference to the accompanying drawings, wherein.

Figure 1:
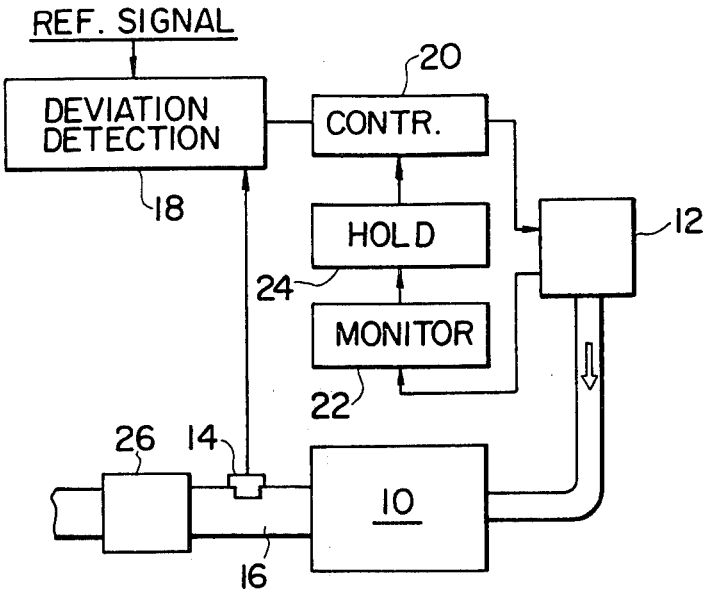
FIG. 1 is a block diagram of an air-fuel ratio control system according to the invention.

In FIG. 1, an internal combustion engine 10 is provided with an air-fuel ratio control system which includes as fundamental components an electrically controllable air-fuel proportioning device 12 such as a carburetor or a fuel injection system, an exhaust sensor 14 installed in the exhaust line 16 of the engine 10, an electrical circuit 18 such as a differential amplifier or a comparator for producing an output signal representing the magnitude of a deviation of the output of the exhaust sensor 14 from a preset reference voltage, and a control circuit 20 which produces a control signal for the control of the air-fuel proportioning device 12 based on the output signal of the comparison circuit 18 in a manner as hereinbefore described. The air-fuel proportioning device 12 has the ability of temporarily stopping the feed of fuel to the engine 10, for example, under an engine brake condition and producing an electrical signal which indicates whether the fuel feed is performed or stopped. For example, a fuel injection system may be made to produce a pulse signal representing a periodical injection of fuel. In the case of a carburetor, it is practicable to make the carburetor continuously produce a constant voltage signal except when the carburetor stops feeding fuel to the engine 10. This fundamental construction of the air-fuel control system is a known one. The engine 10 is provided with also a device 26 for removing noxious substances from the exhaust gas at a section of the exhaust line 16 downstream of the exhaust sensor 14. An example of this device 26 is a catalytic converter containing therein a three-way catalyst.

According to the invention, the air-fuel ratio control system additionally comprises a monitoring circuit 22 which receives the aforementioned electrical signal from the air-fuel proportioning device 12 and produces a voltage signal indicating the cut-off and resumption of the fuel feed, and a hold signal producing circuit 24 which is responsive to the output voltage of the monitoring circuit 22 and supplies a voltage signal to the control circuit 20 for a predetermined amount of time starting from the moment of the commencement or resumption of the fuel feed to the engine 10. Alternatively, the hold signal producing circuit 24 may be so constructed as to supply the voltage signal to the control circuit 20 also during the interruption of the fuel feed to the engine 10. The conventional control circuit 20 is slightly modified to include an additional circuit which may be a switching circuit and has the function of holding the control signal for the air-fuel proportioning device 12 in a constant and preset state while the voltage signal is supplied from the circuit 24.

Figure 2:
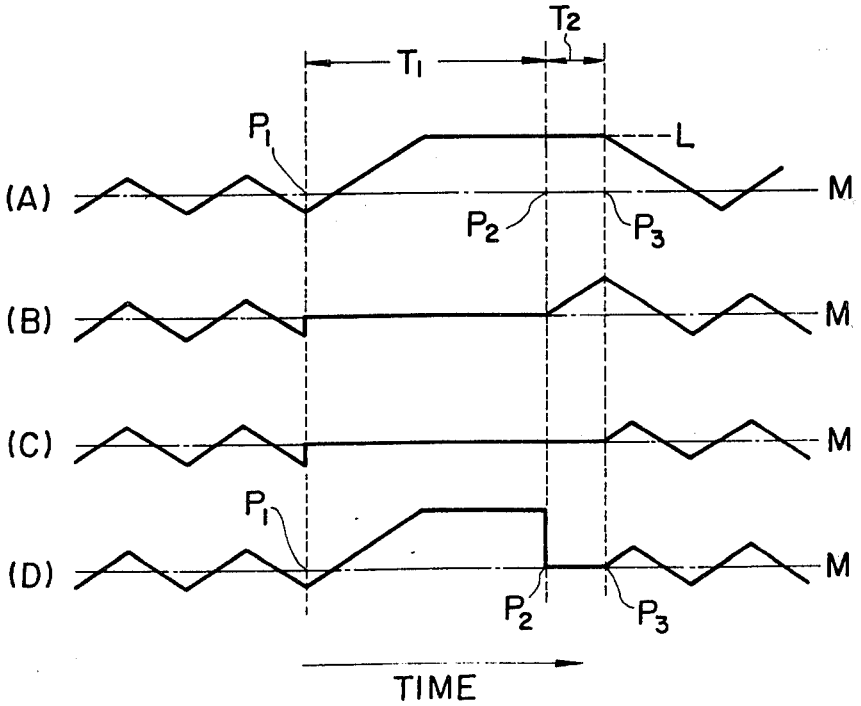
FIG. 2 shows two charts indicating variations of an air-fuel ratio control signal produced by conventional air-fuel ratio control systems by the influence of a temporary cut-off of the fuel feed to the engine and two charts indicating the same for two differntly improved control systems according to the invention.

The function of the control circuit 20 in the event of a temporary cut-off of the fuel feed from the air-fuel proportioning device 12 to the engine 10 will be explained with reference to FIG. 2. In each chart of FIG. 2, a variation of the control signal (the output of the circuit 20) is shown in a simplified form. The horizontal line M represents a standard level of the control signal corresponding to a preset air-fuel ratio, and it is assumed in FIG. 2 that an upward deviation of the control signal from the line M causes the air-fuel ratio proportioning device to lower the air-fuel ratio of the combustible mixture fed to the engine 10. The chart (A) represents a conventional air-fuel ratio control system which does not include the circuits 22 and 24 in FIG. 1. If the fuel feed to the engine 10 is stopped at $P_1$, a resultant variation in the output of the deviation detection circuit 18 causes the control signal (the output of the circuit 20) to vary in such a manner that the air-fuel ratio be greatly lowered until a maximum deviation (indicated at L) from the standard state represented by the line M is realized. The fuel feed is interrupted for a certain period of time $T_1$ and is resumed at $P_2$, but the control signal remains in a maximum deviated state L for an additional period of time $T_2$ from the moment $P_2$ of the fuel feed resumption until the exhaust gas arrives at the exhaust sensor 14 at $P_3$. The control signal commences to approach the standard state M at the time $P_3$, so that the engine 10 is fed with an excessively fuel-rich mixture for an appreciable period of time immediately after the resumption of the fuel feed.

If the control signal is forbidden to vary and is maintained at the standard state M for the period of time $T_1$ from the moment $P_1$ of the start of the fuel feed interruption on condition that the control signal resumes a normal response to the output of the deviation detection circuit 18 simultaneously with the resumption of the fuel feed at $P_2$ as shown in the chart (B), the control signal progressively deviates from the standard state M to lower the air-fuel ratio during the time interval $T_2$ between $P_2$ and $P_3$ for the same reason as in the case of the chart (A). Consequently, an excessively fuel-rich mixture is fed to the engine 10 for a certain period of time immediately after the resumption of the fuel feed despite the maintenance of the control signal in a suitable state during the interruption of the fuel feed.

In the air-fuel ratio control system of FIG. 1 according to the invention, the hold signal producing circuit 24 has the function of holding the control signal in a constant state during the time interval $T_2$ between $P_2$ and $P_3$, but the holding of the control signal may optionally be performed for a longer period of time $(T_1 + T_2)$ by starting the holding at $P_1$. The chart (C) shows a case when the control signal is made to take the standard state M at the commencement of the interruption of the fuel feed and is held in this state until the exhaust gas resumes to come into contact with the exhaust sensor 14 at $P_3$ after the resumption of the fuel feed at $P_2$. Accordingly, the control signal remains in the standard state M during the time interval $T_2$ between $P_2$ and $P_3$ regardless of the output from the deviation detection circuit 18, so that the air-fuel ratio of the combustible mixture fed to the engine 10 during this time interval $T_2$ does not unintentionally lower. After the release of the holding of the control signal at $P_3$, the control signal varies in response to the output of the deviation detection circuit 18 without any influence of the preceding interruption of both the fuel feed and the air-fuel ratio control. The chart (D) shows a case when the holding of the control signal in the standard state M is commenced at $P_2$ simultaneously with the resumption of the fuel feed. In this case the control signal is left to freely deviate from the standard state M while the fuel feed is interrupted, but is shifted from a greatly deviated state to the standard state M at the moment $P_2$ of the fuel feed resumption. Accordingly the state of the control signal during the interruption of the fuel feed (whether the control signal is held constant or left to a free variation) has no influence on the air-fuel ratio of the combustible mixture after the resumption of the fuel feed so long as the control signal is held constantly in an appropriate state during the time interval $T_2$ (a delay in the development of the feedback signal in the air-fuel ratio control system from the resumption of the normal function of the air-fuel proportioning device 12).

The control signal is not necessarily held in the standard state M (corresponding to the preset air-fuel ratio) during the time interval $T_2$ but may alternatively be held in a differently chosen state such as, for example, a state at the commencement of the fuel feed interruption at $P_1$ or a state representing a mean value for momentary variations over a certain period of time immediately before the cut-off of the fuel feed.

The period $T_1$ has been described hereinbefore as of a temporary interruption of the fuel feed to the engine 10. If this period $T_1$ is a very long one, the engine 10 is at rest until it is started at $P_2$. The period $T_2$ for which the control signal is held constant, therefore, is not necessarily be preceded by a temporary interruption of the fuel feed but should be taken as a predetermined amount of time immediately after the commencement of fuel feed to the engine 10.

Figure 3:
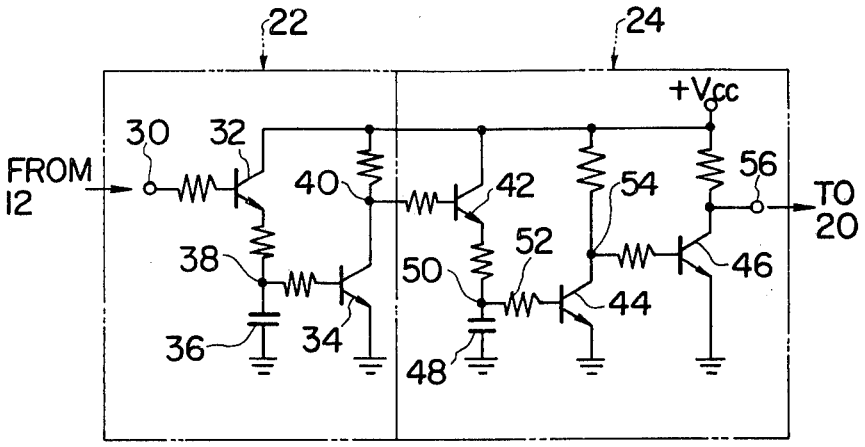
FIG. 3 is a circuit diagram of a fuel feed monitoring circuit and a hold signal producing circuit as a first embodiment of the invention.
Figure 4:
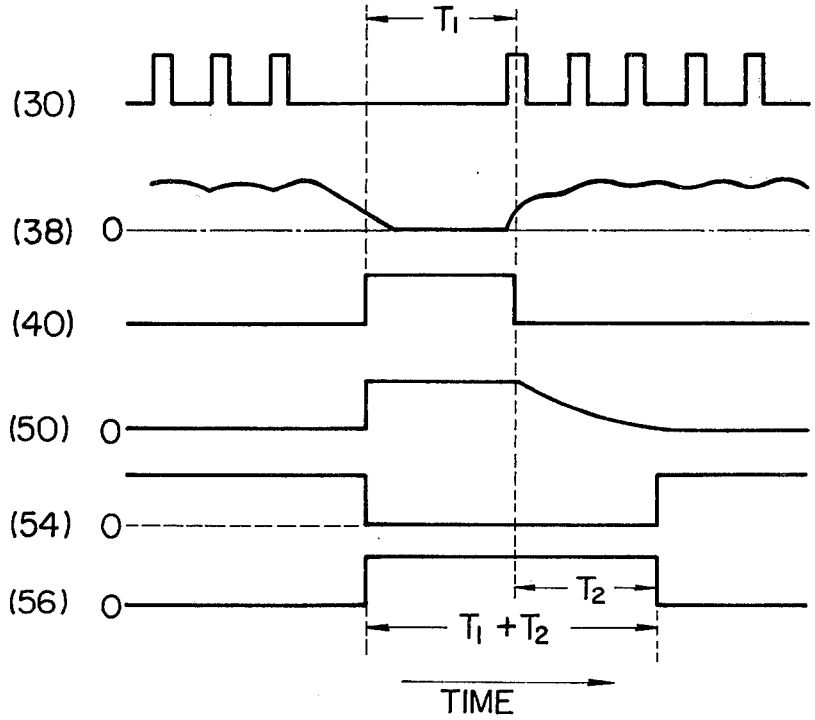
FIG. 4 shows a group of charts respectively indicating variations of voltage signals at several points of the circuits of FIG. 3 by the influence of a temporary cut-off of the fuel feed.

As a first embodiment of the invention, the fuel feed monitoring circuit 22 and the hold signal producing circuit 24 are constructed and connected as shown in FIG. 3. An electrical signal indicating the fuel feed (for example, a pulse signal representing a periodical injection of fuel as shown at (30) in FIG. 4) is supplied to the input terminal 30 of the monitoring circuit 22. The monitoring circuit 22 comprises as fundamental elements first and second transistors 32 and 34 and a capacitor 36. (The description of resistors which are respectively connected in usual manners will be omitted not only for FIG. 3 but also for subsequent Figures.) The base of the first transistor 32 is connected to the input terminal 30 and the emitter to the capacitor 36. A constant voltage Vcc is applied to the collectors of the two transistors 32 and 34, and the emitter of the second transistor 34 is grounded. The emitter of the first transistor 32 is connected also to the base of the second transistor 34. While the air-fuel proportioning device 12 performs the fuel feed to the engine 10, the terminal voltage of the capacitor 36, i.e., the voltage at the junction 38 between the capacitor 36 and the second transistor 34, is high enough to keep the second transistor 34 conductive. When the fuel feed is cut off and the pulse signal (30) disappears, the terminal voltage of the capacitor 36 lowers gradually as shown at (38) in FIG. 4. The second transistor 34 becomes nonconductive when the terminal voltage of the capacitor 36 lowers to a certain value, so that the voltage at the output terminal 40 of the monitoring circuit 22 (the collector voltage of the second transistor 34) exhibits a sharp rise as shown at (40) in FIG. 4. The risen output voltage of the monitoring circuit 22 remains constant while the pulse signal (30) is absent at the input terminal 30, but rapidly lowers to the initial level when the pulse signal (30) is again applied to the input terminal 30 and the capacitor 36 is charged to such a voltage as renders the second transistor 34 conductive.

The hold signal producing circuit 24 has three transistors, namely, third, fourth and fifth transistors 42, 44 and 46, and the constant voltage Vcc is applied to the collectors of these transistors 42, 44, 46. The base of the third transistor 42 is connected to the output terminal 40 of the monitoring circuit 22, and a capacitor 48 is interposed between the emitter of this transistor 42 and the ground. The emitter of the fourth transistor 44 is grounded and the base of this transistor 44 is connected to the junction 50 between the third transistor 42 and the capacitor 48 through a resistor 52. The base of the fifth transistor 46 is connected with the collector of the fourth transistor 44 at a junction 54 while the emitter is grounded. The output terminal 56 of this circuit 24 is arranged to transmit the collector voltage of the fifth transistor 46 to the control circuit 20, but may alternatively be connected to the collector of the fourth transistor 44.

While the monitoring circuit 22 receives the fuel feed signal (30) and hence develops no output voltage, the capacitor 48 of the hold signal producing circuit 24 is not charged since the third transistor 42 remains nonconductive. The third transistor 42 becomes conductive when the second transistor 34 of the monitoring circuit 22 becomes nonconductive, so that a voltage appears at the terminal of the capacitor 48 as shown at (50) in FIG. 4. As a result, the fourth transistor 44 becomes conductive and the fifth transistor 46 nonconductive. Accordingly, the voltage at the junction 54 disappears and at the same time a voltage appears at the output terminal 56 as shown at (54) and (56) in FIG. 4. The third transistor 42 becomes nonconductive when the output voltage of the monitoring circuit 22 disappears after the resumption of the fuel feed. Then the capacitor 48 commences to discharge the stored energy as seen at (50) in FIG. 4. The amount of time $T_2$ needed for the terminal voltage of the capacitor 48 to lower to a value at which the fourth transistor 44 and the fifth transistor 46 respectively become nonconductive and conductive depends on the time constant determined by the capacitance of the capacitor 48 and the resistance of the resistor 52. Thus the output of the circuit 24 shifts to the initial level after the lapse of the time $T_2$ from the fuel feed resumption as seen at (56) of FIG. 4. The hold signal producing circuit 24 of FIG. 3 provides a hold signal (56) not only during the time interval $T_2$ immediately after the resumption of the fuel feed but also during the interruption of the fuel feed (substantially for the period of time $T_1$ in FIG. 2) and hence performs the control method represented by the chart (C) in FIG. 2.

Figure 5:
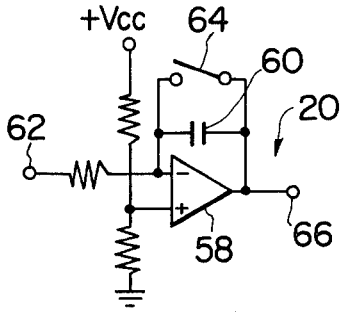
FIG. 5 is a diagram of a control circuit in the air-fuel ratio control system, which is modified according to the invention to be combined with a hold signal producing circuit.

FIG. 5 shows an example of the modification of the control circuit 20 for affording this circuit 20 the ability of holding its output in a constant state upon receipt of a holding signal from the circuit 24. In this example, the control circuit 20 is an integrating circuit having as essential elements an operational amplifier 58 and a capacitor 60 through which a negative feedback for the operational amplifier 58 is accomplished. The output of the deviation detection circuit 18 is applied to the input terminal 62, which is connected to the negative input terminal of the operational amplifier 58. A normally open switch 64 is provided to the integrating circuit in order to short-circuit the capacitor 60 upon receipt of a hold signal from the circuit 24. This switch 64 may be a relay, an analog switch or a switching circuit. While the switch 64 is kept closed, the output voltage of the integrating circuit at the output terminal 66 remains constant regardless of a variation in the amplitude of the input signal at the input terminal 62.

Figure 6:
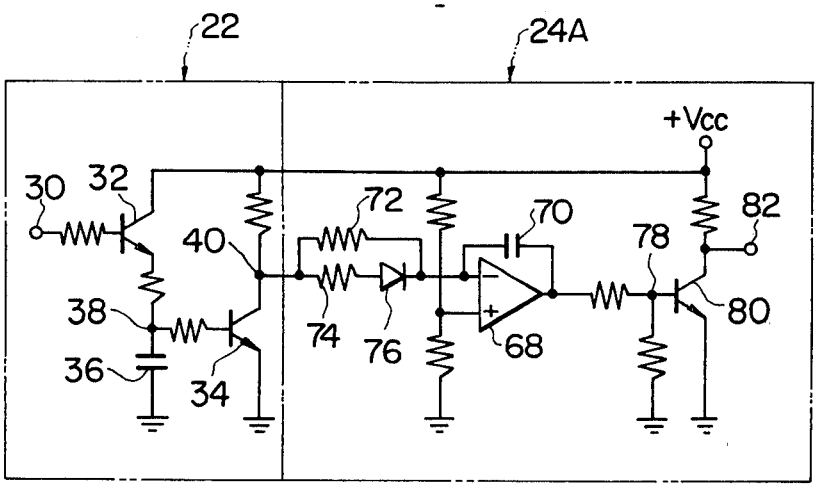
FIG. 6 is a circuit diagram of a differently constructed hold signal producing circuit in combination with the fuel feed monitoring circuit of FIG. 3 as a second embodiment of the invention.

In a second embodiment of the invention shown in FIG. 6, the fuel feed monitoring circuit 22 shown in FIG. 3 is combined with a differently constructed hold signal producing circuit 24A. A fundamental component of the hold signal producing circuit 24A is an integrating circuit comprising an operational amplifier 68 and a capacitor 70 through which a negative feedback for the operational amplifier 68 is accomplished. The output terminal 40 of the monitoring circuit 22 is connected to the negative input terminal of the operational amplifier 68 via a first resistor 72. In parallel with the first resistor 72, a second resistor 74 and a diode 76 provide an additional path from the output terminal 40 of the monitoring circuit 22 to the operational amplifier 68. The first resistor 72 usually but not necessarily has a greater resistance than the second resistor 74. The base of a transistor 80 is connected to the output terminal 78 of the integrating circuit. The collector voltage of this transistor 80 serves as the output of the hold signal producing circuit 24A at its output terminal 82.

Figure 7:
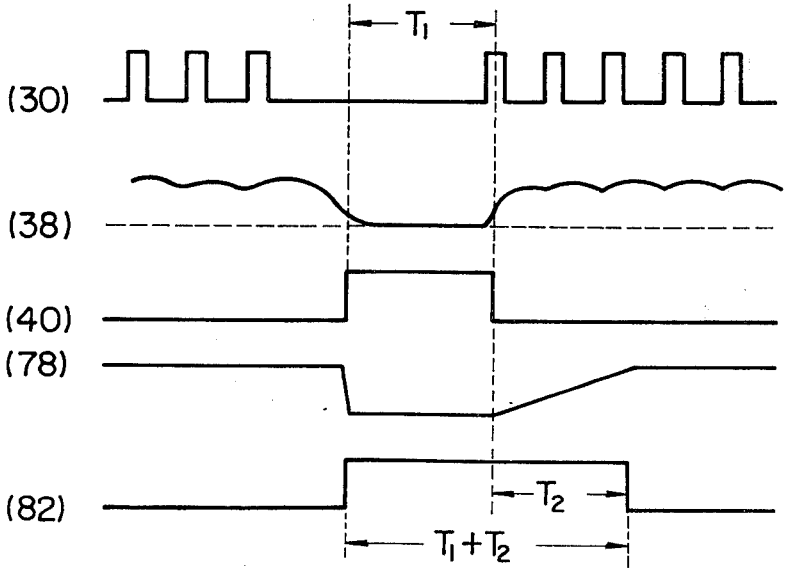
FIG. 7 shows a group of charts indicating the same as the charts of FIG. 4 for the circuits of FIG. 6.

When the monitoring circuit 22 produces the output signal indicating the interruption of the fuel feed as shown at (40) in FIG. 7, the output of the operational amplifier 68 lowers almost to zero volt as shown at (78) in FIG. 7 and renders the transistor 80 nonconductive. Accordingly the circuit 24A supplies a voltage signal as shown at (82) in FIG. 7 to the control circuit 20. When the output signal (40) of the monitoring circuit 22 disappears in response to the resumption of the fuel feed, the output voltage of the operational amplifier 68 begins to rise. Since the integrating circuit has two different time constants respectively for charging and discharging conditions, the rise in the output voltage of the integrating circuit proceeds appreciably slowly as shown at (78) in FIG. 7. The hold signal (82) remains unchanged until the output voltage of the integrating circuit regains a sufficently high level such that the transistor 80 becomes conductive with the delay $T_2$ from the resumption of the fuel feed.

Figure 8:
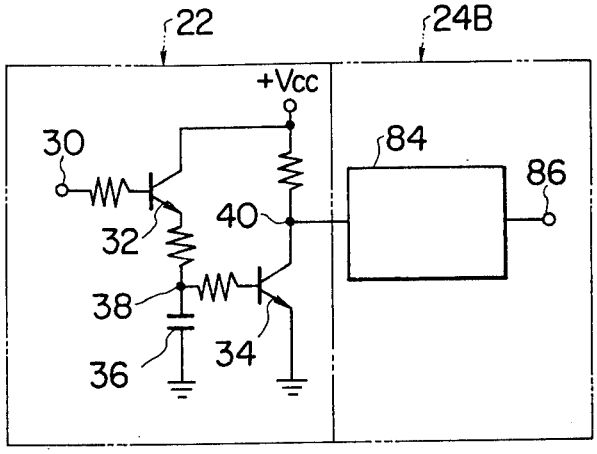
FIGS. 8 and 9 show respectively two still differently constructed hold signal producing circuits in combination with the fuel feed monitoring circuit of FIG. 3 as third and fourth embodiments of the invention.
Figure 10:
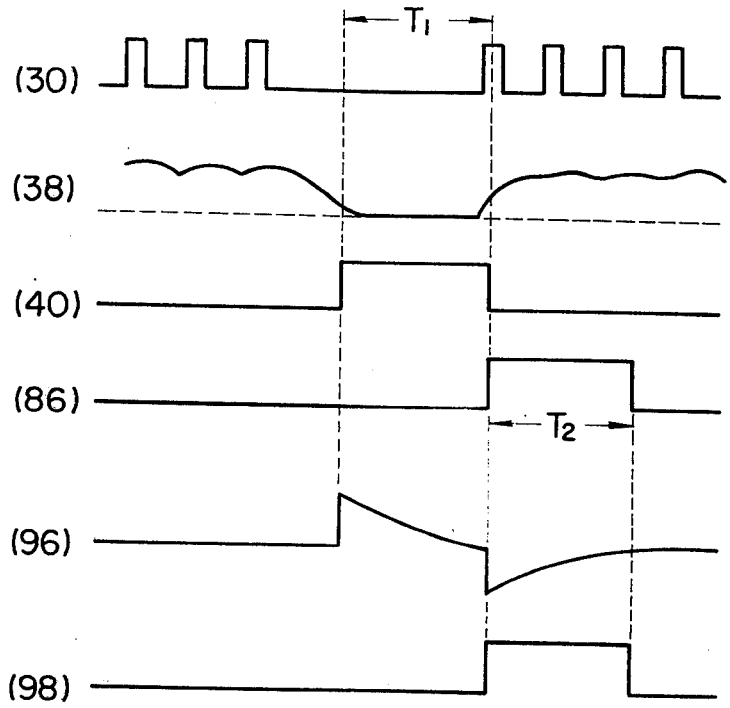
FIG. 10 shows charts which indicate generally the same as FIG. 4 for the circuits of FIGS. 8 and 9.

FIG. 8 shows a third embodiment of the invention wherein the monitoring circuit 22 of FIG. 3 is combined with a still differently constructed hold signal producing circuit 24B. This circuit 24B consists essentially of a monostable multivibrator 84 which can be triggered by the drop of the output voltage (40) in FIG. 10 at the resumption of the fuel feed. A hold signal appears at the output terminal 86 of the circuit 24B when the monostable multivibrator 84 is triggered and disappears after the lapse of the period $T_2$. In this case, the length of the period $T_2$ is determined by the amount of time for which the monostable multivibrator 84 is in a quasi-stable state.

Figure 9:
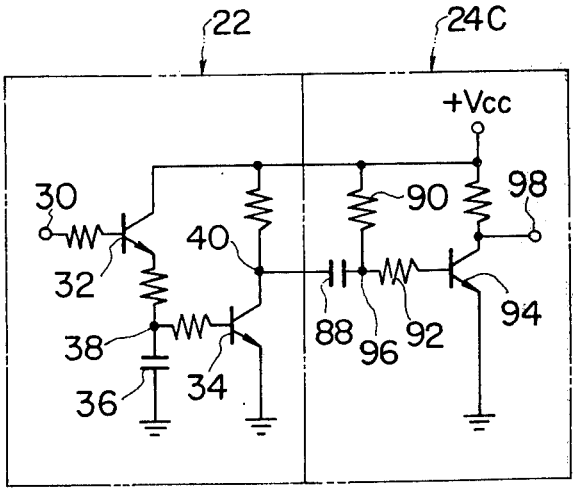

FIG. 9 shows a still another hold signal producing circuit 24C combined with the monitoring circuit 22 of FIG. 3. In this case, the output of the monitoring circuit 22 is applied to a differentiating circuit which is made up of a capacitor 88 and two resistors 90 and 92. In addition, the circuit 24C has a transistor 94 arranged such that the collector voltage of this transistor 94 serves as the output of the circuit 24C. The base of this transistor 94 is connected to the capacitor 88 via the resistor 92. The other resistor 90 is connected such that the voltage Vcc is applied to the junction point 96 between the capacitor 88 and the resistor 92. The voltage at the junction 96 exhibits a sharp rise when the output voltage 40 of the monitoring circuit 22 shifts to the higher level upon cut-off of the fuel feed and then gradually lowers to the original level while the output voltage 40 remains at the higher level. When the output voltage (40) drops at the resumption of the fuel feed, the voltage at the junction 96 exhibits a sharp drop and causes a rise in the collector voltage of the transistor 94, i.e., the voltage at the output terminal 98 of the hold signal producing circuit 24C. Thereafter the voltage at the junction 96 exhibits a gradual rise to the initial level as shown at (96) in FIG. 10. After the lapse of the period $T_2$, which is determined by the time constant of the differentiating circuit, the collector voltage of the transistor 94 drops to the original low level as shown at (98) in FIG. 10. Thus, both the circuits of FIGS. 8 and 9 realize the holding of the control signal in such manner as the chart (D) of FIG. 2.

Figure 11:
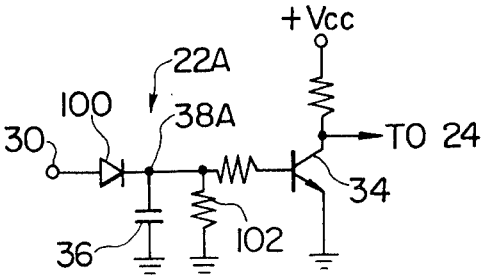
FIG. 11 is a circuit diagram of a differently constructed fuel feed monitoring circuit also as an embodiment of the invention.
Figure 12:
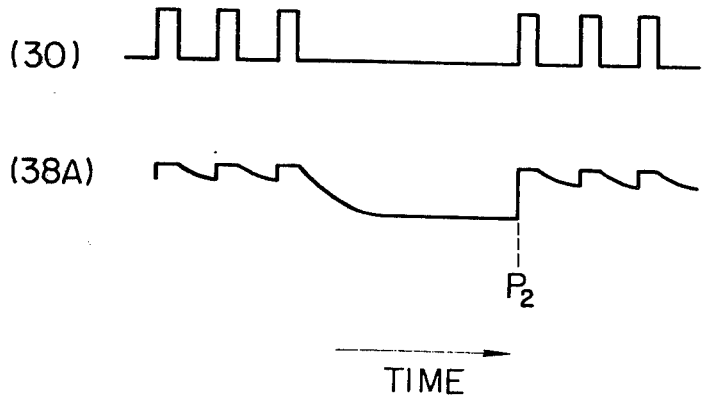
FIG. 12 shows the waveforms of the input and output voltage signals of the circuit of FIG. 11.

FIG. 11 shows a modification of the fuel feed monitoring circuit 22 of FIG. 3. In this monitoring circuit 22A, the input signal (30) is directly applied to the capacitor 36 through a diode 100, and a resistor 102 is connected in parallel with the capacitor 36. When the input signal (30) is the above described pulse signal, the voltage at the junction 38A (the voltage of the capacitor 36) varies as shown at (38A) in FIG. 12. This circuit 22A has the advantage that the voltage of the capacitor 36, which is applied to the base of the transistor 34, exhibits a sharp rise upon reappearance of the input signal (30) at the resumption of the fuel feed.

By the use of any combination of one of the above described fuel feed monitoring circuits and one of the hold signal producing circuits with a slight modification of the control circuit 20 as exemplarily shown in FIG. 5, a temporary cut-off of the fuel feed to the engine 10 for the purpose of improving the fuel consumption and the drivability can optionally be performed without the fear of rendering the air-fuel ratio control system inefficacious at the resumption of the fuel feed. Even when such cut-off of the fuel feed is intended, the air-fuel ratio control system according to the invention can maintain the air-fuel ratio in the vicinity of a preset ratio practically from the moment of starting of the engine.

What is claimed is:

1. In a method of maintaining the air-fuel ratio of a combustible mixture fed to an internal combustion engine at a preset ratio, the method including the steps of producing a first electrical signal representing the concentration of a particular component of the exhaust gas of the engine, said concentration having dependence on the air-fuel ratio of the combustible mixture consumed in the engine, producing a second electrical signal representing a deviation of the first electrical signal from a reference signal, producing a variable control signal for the control of an air-fuel proportioning device based on the second electrical signal, the improvement comprising the step of holding the control signal constantly in a predetermined state for a predetermined amount of time immediately after the start of the feed of the combustible mixture from the air-fuel proportioning device to the engine either at starting of the engine or at the end of a temporary interruption of the feed of the combustible mixture during operation of the engine, said predetermined amount of time being determined according to a time delay in the appearance of the first electrical signal from the start of the feed of the combustible mixture.

2. A method as claimed in claim 1, further comprising the step of holding the control signal in said predetermined state also while the feed of the combustible mixture is temporarily interrupted.

3. In a feedback control system for maintaining the air-fuel ratio of a combustible mixture fed to an internal combustion engine at a preset ratio, the system having an electrically controlled air-fuel proportioning device, a sensor means for producing a first electrical signal representing the concentration of a particular component of the exhaust gas of the engine, said concentration having dependence on the air-fuel ratio of a combustible mixture consumed in the engine, a deviation detection means for producing a second electrical signal representing a deviation of the first electrical signal from a reference signal and a control means for producing a variable control signal for the control of the air-fuel proportioning device based on the second electrical signal, the improvement comprising: a monitoring means for producing an electrical monitoring signal indicating whether the air-fuel proportioning device performs the feed of the combustible mixture to the engine or not; a hold signal producing means for supplying an electrical hold signal to the control means for a predetermined amount of time from the moment said monitoring signal indicates the start of the feed of the combustible mixture to the engine, the predetermined amount of time being determined according to a time delay in the arrival of the exhaust gas at the sensor means from the start of the feed of the combustible mixture; and a switching means for holding the control signal constantly in a predetermined state while the hold signal is supplied to the control means.

4. A control system as claimed in claim 3, wherein said hold signal producing means supply said hold signal to the control means also while the monitoring signal indicates that the air-fuel proportioning device does not feed the combustible mixture to the engine.

5. A control system as claimed in claim 3, wherein said control means comprise an integrating circuit having an operational amplifier and a capacitor through which a negative feedback is provided for said operational amplifier, said second electrical signal being applied to the negative input terminal of said operational amplifier, said switching means being arranged such that said capacitor is shortcircuited while said hold signal is supplied to said control means.

6. A control system as claimed in claim 3, wherein said monitoring means comprise a capacitor arranged to be charged and discharged while the air-fuel proportioning device performs and stops the feed of the combustible mixture to the engine, respectively, and a transistor connected with said capacitor such that a collector voltage which serves as said monitoring signal develops only while said capacitor is in a discharging state.

7. A control system as claimed in claim 6, wherein said monitoring means further comprise another transistor arranged such that said capacitor is charged with an emitter voltage of said another transistor.

8. A control system as claimed in claim 6, wherein said monitoring means further comprise a diode through which said capacitor is charged and a resistor in parallel with said capacitor for determining the time constant for the discharge of said capacitor.

9. A control system as claimed in claim 6, wherein said hold signal producing means comprise a capacitor, a first transistor through which a voltage is applied to said capacitor of said hold signal producing means, said collector voltage of said transistor of said monitoring means being applied to the base of said first transistor to govern the conductivity of said first transistor, a second transistor with the base thereof connected to said capacitor of said hold signal producing means through a resistor, the collector voltage of said second transistor serving as said hold signal, the capacitance of said capacitor of said hold signal producing means and the resistance of said resistor being chosen to give a time constant corresponding to said predetermined amount of time.

10. A control system as claimed in claim 6, wherein said hold signal producing means comprise a first resistor, a second resistor connected in series with a diode and in parallel with said first resistor, an integrating circuit having an operational amplifier and a capacitor through which a negative feedback is provided for said operational amplifier, said collector voltage of said transistor of said monitoring means being applied to the negative input terminal of said operational amplifier through said first and second resistors, and a transistor with the base thereof connected to the output terminal of said integrating circuit, the collector voltage of said transistor of said hold signal producing means serving as said hold signal.

11. A control system as claimed in claim 6, wherein said hold signal producing means comprise a monostable multivibrator arranged to be triggered by a drop of said collector voltage of said transistor of said monitoring means, the output of said monostable multivibrator during a quasi-stable state serving as said hold signal.

12. A control system as claimed in claim 6, wherein said hold signal producing means comprise a differentiating circuit having a capacitor connected to the collector of said transistor of said monitoring means, a first resistor through which a voltage is applied to said capacitor of said differentiating circuit and a second resistor also connected to the same capacitor, and a transistor with the base thereof connected to said capacitor of said differentiating circuit through said second resistor, the collector voltage of said transistor of said hold signal producing means serving as said hold signal.

* * * * *